US005960716A

United States Patent [19]

Schaede

[11] Patent Number: 5,960,716

[45] Date of Patent: Oct. 5, 1999

[54] IMPRESSION CYLINDER OF A SHEET-FED MACHINE HAVING GRIPPERS AND A COVER ARRANGED IN A CYLINDER PIT

[75] Inventor: Johannes Schaede, Würzburg, Germany

[73] Assignee: De La Rue Giori, S.A., Lausanne, Switzerland

[21] Appl. No.: 09/117,856

[22] PCT Filed: Feb. 18, 1997

[86] PCT No.: PCT/CH97/00061

§ 371 Date: Aug. 12, 1998

§ 102(e) Date: Aug. 12, 1998

[87] PCT Pub. No.: WO97/29912

PCT Pub. Date: Aug. 21, 1997

[30] Foreign Application Priority Data

Feb. 19, 1996 [CH] Switzerland ..... 0429/96

[51] Int. Cl.[6] ..... B41F 21/04

[52] U.S. Cl. ..... 101/409; 101/116; 101/118

[58] Field of Search ..... 101/116, 117, 101/118, 119, 120, 246, 409, 415.1

[56] References Cited

U.S. PATENT DOCUMENTS

| | | | |
|---|---|---|---|
| 1,597,250 | 8/1926 | Rowley | 101/415.1 |
| 4,813,356 | 3/1989 | Abendroth et al. | 101/409 |
| 4,875,069 | 10/1989 | Takada et al. | 101/408 |
| 5,671,671 | 9/1997 | Wyssmann et al. | 101/120 |
| 5,690,027 | 11/1997 | Takahashi et al. | 101/120 |

FOREIGN PATENT DOCUMENTS

| | | |
|---|---|---|
| 0 723 864 B1 | 8/1998 | European Pat. Off. . |
| 30 15 236 | 12/1980 | Germany . |
| 40 13 261 | 6/1991 | Germany . |
| 1138369 | 1/1969 | United Kingdom . |

*Primary Examiner*—Edgar Burr
*Assistant Examiner*—Leslie J. Grohusky
*Attorney, Agent, or Firm*—Kane, Dalsimer, Sullivan, Kuruca, Levy, eisele and Richard, LLP

[57] ABSTRACT

The invention relates to an impression cylinder (1) intended for a sheet-fed machine and having at least one cylinder gap (3) in which sheet grippers (4) are arranged in such a manner that, when closed, they do not project over the envelope of the peripheral area of the impression cylinder (1). The cylinder gap (3) is provided with a cover (7) which can be adjusted by a controlling unit (9, 10, 11, 12) and is subsequently always in its closed position in which it completely covers the cylinder gap (3), when said gap (3) passes through the nip. Consequently, the impression cylinder rolls with a continuous, closed peripheral area on the cylinder printing the image. In the zones where the sheet is transferred to and from the impression cylinder (1), the cover (7) (preferably controlled by a fixed cam (11) while the cylinder is rotating) is opened to such an extent that the sheet grippers (4) can move into the open position thereof to pick up or release a sheet.

5 Claims, 2 Drawing Sheets

IMPRESSION CYLINDER OF A SHEET-FED MACHINE HAVING GRIPPERS AND A COVER ARRANGED IN A CYLINDER PIT

The invention concerns an impression cylinder for a sheet printing machine, having at least one cylinder pit in which sheet grippers are arranged.

Such impression cylinder are long known in the art, particularly in the field of indirect printing machines such as offset printing machines (see for example GB patent 1138369), in direct printing machines such as intaglio printing machines and also in screen printing machines. The known impression cylinder have always had printing saddles separated by pits, the circumferential length of the printing saddles corresponding to the size of the sheet to be printed and the pits being necessary for housing the sheet grippers.

Such impression cylinders with an external surface interrupted by pits make problems during the printing process. At each outset of pressure, that is when a printing saddle comes into contact in a collision-like manner with the cylinder printing the image, a collision excitation is created which may influence the quality of the impression. In offset printing, changes in the pressure between the blanket cylinder and the impression cylinder may even occur. In the case of slim cylinders, that is when their length is greater than their diameter, undesired vibration streaks may be created because of the insufficient rigidity or because of the collision excitation.

A particular problem occurs in rotary screen printing machines, in which an elastically flexible screen printing stencil is stretched on the circumference of a form cylinder. This screen printing stencil is stressed on the inside by a doctor blade which accumulates upstream of the printing nip the ink bead necessary for the printing operation. During the passage of a cylinder pit of the impression cylinder, the screen printing stencil is not supported anymore by the circumference of the impression cylinder and is more or less forced into the pit by the pressure of the doctor blade and may thus be damaged. In order to avoid this danger, it has been proposed in the previous European Patent Application N° 96810043.8 issued to the same applicant to mount the doctor blade displaceable inside the screen printing cylinder in such a way that the blade is lifted off and away from the screen printing stencil each time a pit of the impression cylinder passes the printing nip.

The object of the present invention is to provide an impression cylinder for a sheet printing machine such that the effects and the drawbacks created in an impression procedure by the presence of cylinder pits can be removed in a simple way.

This object is achieved by the impression cylinder according to the invention, wherein the sheet grippers, when in closed position, do not rise above the peripheral surface of the cylinder and in that each cylinder pit is provided with a cover which is movable by an adjusting mechanism in a first position in which the cover completely covers the cylinder pit with the grippers in closed position thereby completing the peripheral surface of the impression cylinder, and in a second position in which the cover opens at least partially the pit in the region of the grippers.

The impression cylinder and its adjusting mechanism are hence constructed in a way such that each cylinder pit is always completely closed when, during the printing process, the pit passes the printing nip, and sufficiently opened during a transfer of a sheet onto the impression cylinder or away from the impression cylinder so that the grippers can be opened and the transfer of the sheets can take place in the usual manner. When transfer cylinders with grippers are used for transferring the sheets onto and away from the impression cylinder, the cylinder pit is then so opened during the transfer that the grippers of the transfer cylinder can penetrate inside the pit of the impression cylinder, as is usually done.

With the invention, one obtains that, during the printing process, the impression cylinder rolls with a closed and practically continuous surface against the cylinder printing the image, which can be in particular either a screen printing cylinder or a blanket cylinder of an offset printing machine. The impression cylinder according to the invention may also be used in a raised impression machine.

The construction and the surface of the impression cylinder and of the printing saddles are always adapted to the type of the printing machine.

Preferably, the cover has a hardness or a surface which corresponds to that of the impression cylinder.

In the case of a screen printing machine, the particular following advantage is obtained: no additional means are necessary for preventing the flexible screen printing stencil being pressed inside a cylinder pit by the doctor blade and damaged during the printing process. Also in the case of so-called gapless sheet offset printing machines in which the impression cylinder and the blanket cylinder have a continuous peripheral surface, an impression cylinder according to the invention with a peripheral surface which is closed during the impression process is advantageous, since it prevents in an efficient manner vibrations and changes in the printing pressure between the blanket cylinder and the impression cylinder.

Further embodiments of the invention are defined in the appended dependent claims.

The invention will become more apparent from the following description taken in connection with the accompanying drawings, in which.

Figure 1:
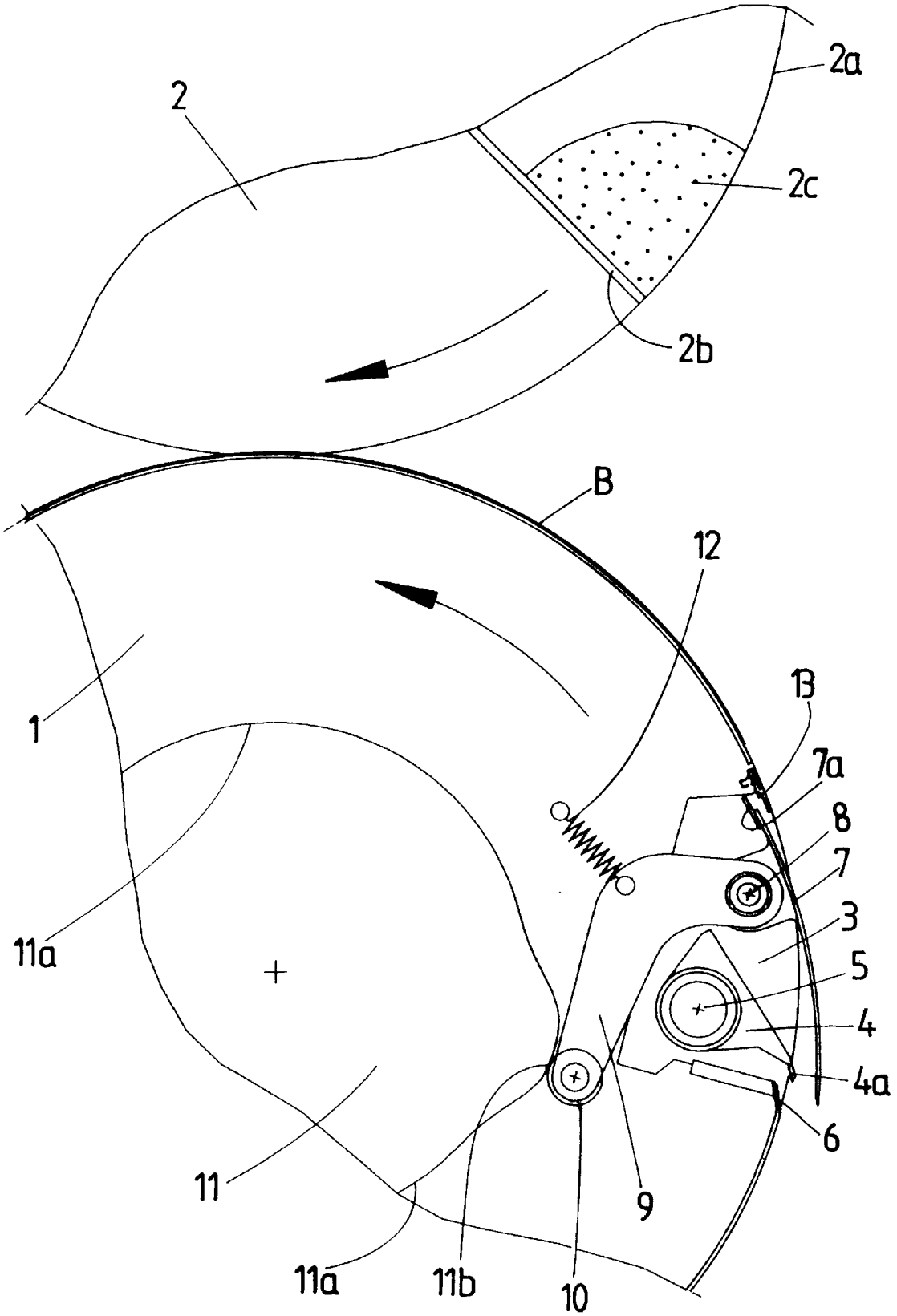
FIG. 1 shows an impression cylinder according to the invention co-operating with a screen printing cylinder in a relative position in which a partially opened cylinder pit is one quarter turn away from the printing nip, both cylinders being only partially represented.

In the representation of the drawings, an impression cylinder 1 according to the invention co-operates with a screen printing cylinder 2, its circumference consisting of a cylindrical elastic screen printing stencil 2*a*, and inside of which the ink bead 2*c* is accumulated by a doctor blade 2*b*. Both cylinders, which turn in the direction of the arrows, constitute between them the printing nip through which the sheet B are lead by the impression cylinder 1 for the printing process.

The impression cylinder 1 has only one cylinder pit 3 in the example considered and thus only one printing saddle for retaining the sheet B. Of course, the impression cylinder may also have two or more equally spaced pits and printing saddles for retaining two or more sheets B, however all cylinder pits have the same construction.

In the cylinder pit 3, adjustable sheet grippers 4 are mounted on a gripper spindle 5, which, in a known manner, moves between an opened position (FIG. 1), in which the gripper edge 4*a* rises above the cylinder periphery, and a closed position (FIG. 2) in which the gripper edge does not rise above the cylinder periphery. In the closed position, the grippers press with their edge 4*a* the front edge of a sheet B against the support 6 which is inclined towards the inside of the cylinder with respect to the cylinder periphery.

The cylinder pit is further provided with an adjustable cover 7, which is movable around a spindle 8 between a closed position (FIG. 2) and an opened position (FIG. 1) partially opening the cylinder pit. The adjusting mechanism comprises an angle-shaped control lever 9, one end of which is fixed to the cover 7 around the spindle 8 and the other end carries a cam roller 10, a stationary radial cam 11 which, when rotating the impression cylinder 1, drives the cam roller 10 and thus the control lever 9 with the cover 7, and a spring 12 which presses the control lever with its cam roller 10 against the radial cam 11 and is mounted on the impression cylinder 1.

The radial cam 11 has a peripheral surface 11*a* concentric to the axis of the impression cylinder 1 and two peripheral surfaces projecting towards outside, each being placed in the region in which a sheet is taken-over by the impression cylinder and in which a sheet is delivered by the impression cylinder, from said two peripheral surfaces only the peripheral surface 11*b* projecting towards outside in the region in which a sheet is transferred onto the impression cylinder being represented in the figures. This disposition is arranged in such a way that the cover 7 completely closes the pit 3 as long as the cam roller 10 rolls on the peripheral surface 11*a* of the radial cam 11, and that the cover 7 is partially opened when the cam roller 10 passes the peripheral surface 11*b* projecting towards outside of the radial cam 11. The opening of the cover 7 is thus realised by a partial swing out on the side on which the grippers are located.

The cover 7 has the same curvature as the peripheral surface of the impression cylinder so that, when in its closed position (FIG. 2), the impression cylinder has a continuous closed surface. In addition, the material of the cover corresponds to the material of the peripheral surface of the impression cylinder and hence has the same hardness; in the example considered, the material used is preferably a metallic material.

Figure 2:
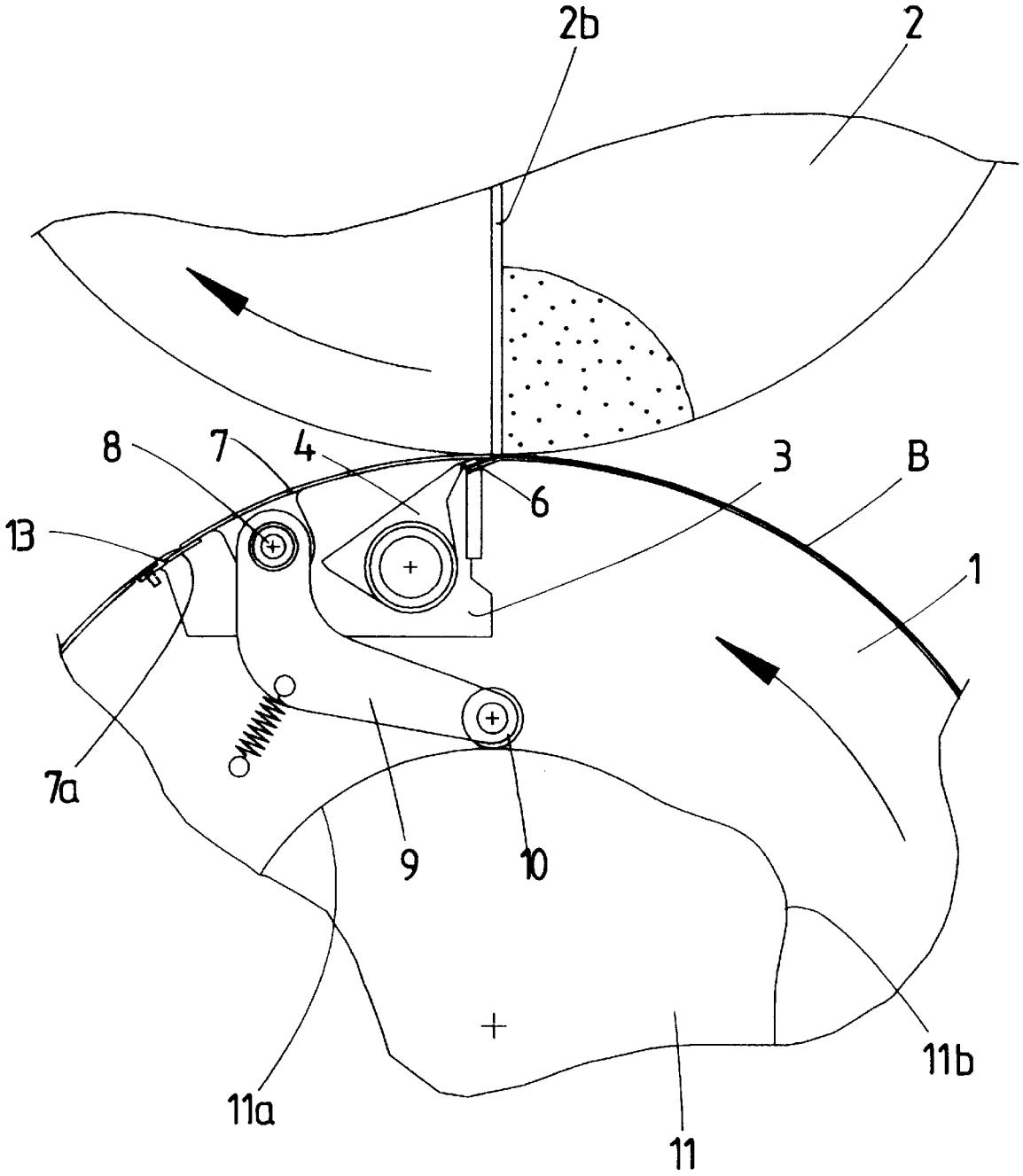
FIG. 2 shows both cylinders of FIG. 1 in the position in which the totally closed pits have just passed the printing nip.

In order to fill the gap between the side of the cover 7 which is away from the sheet grippers 4 and the surface of the impression cylinder in a seamless manner when the cover is in closed position, an elastic strip 13 is placed in the cylinder pit 3 on the side away from the sheet grippers 4, in prolongation of the cylinder peripheral surface, an end part 7*a* of the cover 7 offset towards the inside applying on the underside of said strip in closed position, as shown in FIG. 2.

The cover 7 is adjusted in the following manner during the printing process:

In order to take-over an incoming sheet, transferred for example from the sheet grippers of a transfer cylinder (not shown) to the sheet grippers 4 in the pits 3 of the impression cylinder 1, the cover is partially so opened, as shown in FIG. 1, so that the sheet grippers 4 will take their opened position and the sheet grippers of the transfer cylinder, which hold the front edge of the sheet, may penetrate sufficiently into the pit 3. As soon as the front edge of the incoming sheet is arrived under the gripper edge 4*a* of the sheet grippers 4, these grippers will be moved in their closed position in a known manner, such that the edge of the sheet released by the grippers of the transfer cylinder will be pinched between the gripper edge 4*a* and the support 6. If the impression cylinder 1 is further rotated, the cam roller 10 arrives on the peripheral zone 11*a* of the radial cam 11 and leads therethrough to the closing of the cover 7, which completely covers the cylinder pit and the closed sheet grippers 4. The end of the cover which is over the grippers 4 overlaps then the front edge of the sheet. In this closed position, the rigid cover 7 passes the printing nip (FIG. 2) acting as a rigid support for the doctor blade 2*b* pressing against the screen printing stencil 2*a*, so that the screen printing stencil is not damaged. A rise of the doctor blade is thus not necessary.

In the representation of FIG. 2, the closed cover 7 has just completely passed the printing nip and the impression of the sheet B starts. As soon as the cam roller 10, in the region of the sheet delivery, rolls on the projecting surface 11*b*, which is not represented, of the radial cam 11, the cover 7 goes back in its opened position, so that the sheet grippers open and release the edge of the sheet, which is then taken over by the transfer device further transporting the sheet, such as for example a transfer cylinder with sheet grippers.

In the example considered, the cover 7 goes in its opened position only in the region of the sheet take-over and of the sheet delivery. This arrangement may however be made such that the opened position is maintained between delivery of a printed sheet and taking over of an incoming sheet. What is important is that the cover 7 goes into its closed position when a cylinder pit passes the printing nip.

In other type of sheet impression machines, as for example in offset printing machines and raised impression machines, the collision excitation at the outset of pressure is avoided by the use of an impression cylinder according to the invention, so that not only an impairment of the impression quality is avoided but also the impression speed attained is higher than previously.

The invention is not restricted to the described exemplary embodiments, but covers other different alternatives particularly with respect to the adjusting mechanism.

I claim:

1. Impression cylinder for a sheet printing machine, having an adjusting mechanism, at least one cylinder pit (3) having an end in which sheet grippers (4) are arranged, wherein the sheet grippers (4), when in a closed position, do not rise above the peripheral surface of the cylinder (1) and in that each cylinder pit (3) is provided with a cover (7) having an end which is movable by the adjusting mechanism (9-12) in a first position in which the cover (7) completely covers the cylinder pit (3) with the grippers (4) in closed position thereby completing the peripheral surface of the impression cylinder (1), and in a second position in which the cover (7) opens at least partially the pit (3) in the region of the grippers (4).

2. Impression cylinder as claimed in claim 1, wherein the cover (7) is movable around a spindle (8) placed inside the cylinder pit (3).

3. Impression cylinder as claimed in claim 1, wherein the cover (7), when in a closed position, contacts an elastic strip (13) at the end of the pit (13) opposed to the grippers (4), said strip filling any space between said end of the cover and the surface of the impression cylinder.

4. Impression cylinder as claimed in claim 1, wherein the adjusting mechanism comprises a fixed radial cam (11).

5. Impression cylinder as claimed in claim 1, wherein the material of the cover (7) corresponds to the material of the surface of the impression cylinder.

* * * * *